US007255653B2

(12) United States Patent
Saso

(10) Patent No.: US 7,255,653 B2
(45) Date of Patent: Aug. 14, 2007

(54) METAL WOOD CLUB

(76) Inventor: Mitsuhiro Saso, 2-291-11, Iida, Himeji-City, Hyogo 670-0974 (JP)

( * ) Notice: Subject to any disclaimer, the term of this patent is extended or adjusted under 35 U.S.C. 154(b) by 148 days.

(21) Appl. No.: 10/768,003

(22) Filed: Feb. 2, 2004

(65) Prior Publication Data

US 2005/0170907 A1 Aug. 4, 2005

(51) Int. Cl.
*A63B 53/04* (2006.01)

(52) U.S. Cl. ..... 473/345; 473/349

(58) Field of Classification Search ..... 473/324–350, 473/290–291; D21/733–735, 759
See application file for complete search history.

(56) References Cited

U.S. PATENT DOCUMENTS 1,139,985 A * 5/1915 Legh ..... 473/350
1,671,956 A * 5/1928 Sime ..... 473/329
1,916,792 A * 7/1933 Hadden ..... 473/324
3,625,518 A 12/1971 Solheim
3,966,210 A * 6/1976 Rozmus ..... 473/341
D240,948 S * 8/1976 Redoutey ..... D21/747
5,060,949 A * 10/1991 Brill ..... 473/328
5,078,400 A 1/1992 Desbiolles et al.
D326,130 S * 5/1992 Chorne ..... D21/733
5,186,465 A * 2/1993 Chorne ..... 473/350
5,203,565 A * 4/1993 Murray et al. ..... 473/242
D354,782 S * 1/1995 Gonzalez, Jr. ..... D21/752
5,573,467 A * 11/1996 Chou et al. ..... 473/289
D465,251 S * 11/2002 Wood et al. ..... D21/752
6,669,579 B2 * 12/2003 Kosmatka ..... 473/342
6,942,581 B2 * 9/2005 Kim et al. ..... 473/345

FOREIGN PATENT DOCUMENTS

JP 01-300970 5/1989
JP 2003230642 8/2003

OTHER PUBLICATIONS

Advertisement for "Xstreamliner" Driver from The Golfworks (Trademark) 2002 Clubmaker's Catalog, p. 17 and front page.

* cited by examiner

*Primary Examiner*—Sebastiano Passaniti
(74) *Attorney, Agent, or Firm*—Ryndak & Suri LLP

(57) ABSTRACT

A golf club having a metal wood club head including a toe, a heel, a club face, a sole, a rear profile, and a top profile shape. The club head is shaped to increase the moment of inertia of the club head. In one embodiment, a rear portion of the club head is truncated such that a top profile maximum width of the toe side and a top profile maximum width of the heel side are larger than a transverse top profile centerline width of the club head. The sole of the club head may have a sole recess which extends from the truncated region and through a portion of a center of the sole. In another embodiment, the wood club head approximates an elongated rectangular shape.

41 Claims, 6 Drawing Sheets

METAL WOOD CLUB

BACKGROUND OF THE INVENTION

1. Field of the Invention

The present invention relates to a golf club, and more particularly to a golf club wood head having a relatively high moment of inertia which is very forgiving to an off-center hit.

2. Description of the Prior Art

Numerous types of wood clubs are known in the art for driving golf balls a long distance. Prior to the advent and golfer acceptance of metal woods in the late 1970s to 1980s, wood golf clubs were known. These wood clubs typically were composed of a wooden head connected to the end of a shaft. The head of the wood club was solid wood, hence the term "wood" for the club. Typically, the wooden club head had a metal sole plate (a relatively thin metal plate attached to the bottom surface of the wooden head) and a central club face insert to improve the durability and wear characteristics of the club head.

It is now appreciated that these antiquated wooden club heads had a relatively low moment of inertia. The moment of inertia of a club head or other body is a measure of its susceptibility to rotation. A well-known example demonstrating the effect of a change in the moment of inertia is a spinning figure skater—the skater spins more slowly when the skater's arms are outstretched sideways (relatively high moment of inertia) as compared to when the arms are held close to the body or when extended straight up (relatively low moment of inertia).

For wood clubs, the greater the moment of inertia, the less susceptible the club head is to rotating when the club face impacts a ball with an off-center hit. Thus, a higher moment of inertia club head will produce a better shot on an off-center hit than a club head with a lower moment of inertia. With this principle in mind, numerous improvements to metal wood clubs are known and have been proposed.

For example, metal wood clubs were developed which included a metal club head having a hollow metal body. The mass of the club head was located substantially around the perimeter of the club head. For a given size club head, this resulted in a substantially greater moment of inertia than a solid wooden club head where the mass was distributed throughout the body of the club head.

Other "improved" metal club heads increased the club head size or volume while maintaining the club head weight essentially the same (typically about 200 grams or about 7 ounces) while overall generally having the typical wood head shape.

A need exists for an improved wood golf club which has a relatively high moment of inertia around the center of gravity of the club head, and thus results in improved directional stability and flight distance of a hit ball without requiring as large a club head volume for a given moment of inertia compared to a metal wood club head having an overall generally typical or conventional wood head shape, such as the stated conventional club head shape in FIG. 1 of U.S. Pat. No. 5,645,495, for example.

SUMMARY OF THE INVENTION

In accordance with one aspect of the present invention, a golf club is provided that is composed of a metallic wood club head having a toe, a heel, a club face and a top profile shape. The club head has a top profile maximum length in a transverse top profile centerline with the ratio of the top profile maximum length to the transverse top profile centerline width being in the range of about 1.5 to about 2.2. Further, in this embodiment, the club head has a toe side, a heel side and a top profile maximum width on the toe side and a top profile maximum width on the heel side, each of the top profile maximum width of the toe side and the top profile maximum width of the heel side being larger than the transverse top profile centerline width.

In accordance with another aspect of the invention, the inventive golf club comprises a hollow metal wood club head including a toe, a heel, a club face and a top profile shape, the club head having a top profile maximum length and a top profile centerline width, and a ratio of the top profile maximum length to the top profile centerline width being in the range of from about 1.5 to about 2.2 and the metal wood club head has a volume of at least about 225 cubic centimeters. In another embodiment, the volume of the club head is at least about 275 cubic centimeters and in still another embodiment the volume of the club head is at least about 325 cubic centimeters. More particularly, the ratio of the top profile maximum length to the transverse top profile centerline width is in the range of from about 1.55 to about 2.2 and may be in the range of from about 1.6 to about 1.7.

In another aspect of the present invention, a portion of the rear of the club head is truncated such that mass is removed from a central rear region of the club head so as to result in a relatively higher moment of inertia in a vertical and horizontal plane of the club head. As a result of the truncated portion, the club head can have a top profile maximum width on the toe side and a top profile maximum width on the heel side of the club head, wherein both the top profile maximum width of the toe side and the top profile maximum width of the heel side are larger than the transverse top profile centerline width. In one embodiment, the top profile maximum width of the heel side is greater than the top profile maximum width of the toe side. In another embodiment, the top profile maximum width of the toe side and the top profile maximum width of the heel side are substantially equal.

In one embodiment, the truncated portion extends from between a most rearward point of the toe side and a most rearward point of the heel side. Additionally, the truncated portion preferably comprises a concave rear region which forms a rear portion of the club head. In another embodiment, the concave rear region comprises a rear region wall which forms a rear portion of the club head.

The width of the truncated portion relative to the maximum heel side or toe side width of the club head is typically as follows. The distance between (1) a line which is parallel to the top profile maximum length and intersects either the most rearward point of the toe side and/or the heel side and (2) a line which is perpendicular to the transverse top profile centerline and intersects the top profile innermost point of the truncated portion is preferably 20% or less of the top profile maximum width of the heel side.

The length of the truncated portion and length relative to the top profile maximum width of the club head is typically as follows. The ratio of (1) the distance (which is the length of the truncated portion) between (a) a line parallel to the transverse top profile centerline of the club head and extending through the top profile maximum width on the toe side and (b) a second line parallel to the transverse top profile centerline and extending through the top profile maximum width on the heel side and (2) the top profile maximum length is typically in the range of between about 0.35 and about 0.70, and more preferably in the range of between about 0.40 and about 0.60.

In yet another embodiment of the present invention, the club head shape is such that the top profile length of the club head between (1) a line parallel to the transverse top profile centerline and extending through the toe side most rearward point and a line which extends parallel to the transverse top profile centerline width and intersects an outermost point of the toe side is equal or substantially equal to (2) a top profile length between a line parallel to the transverse top profile centerline and which extends through the heel side most rearward point and a line which extends parallel to the transverse top profile centerline or centerline plane and intersects an outermost point of the heel side.

To further remove or redistribute mass from the rear portion and central portion of the club head and distribute the mass where desired, such as in the toe and heel regions of the club head, to increase the moment of inertia of the club head, the sole preferably has a sole recess which extends from the truncated portion through a portion of a center of the sole. The sole recess is typically defined by two generally vertical walls, each typically having a maximum height in the range of from about 0.15 to about 0.30 inches. Additionally, the sole recess is preferably of substantially the same contour as the adjacent regions of the sole of the club head. Further, the sole recess is preferably of a substantially triangular shape, but may be of a rectangular shape, polygonal shape, or any other desired shape which removes a mass from a central portion of the sole. Quantitatively, the sole recess has a volume which typically is in the range of from about 2% to about 8% of the club head. The sole recess typically has a horizontal maximum width that is about 20% or more of the transverse top profile centerline width.

DETAILED DESCRIPTION OF THE INVENTION

Figure 1:
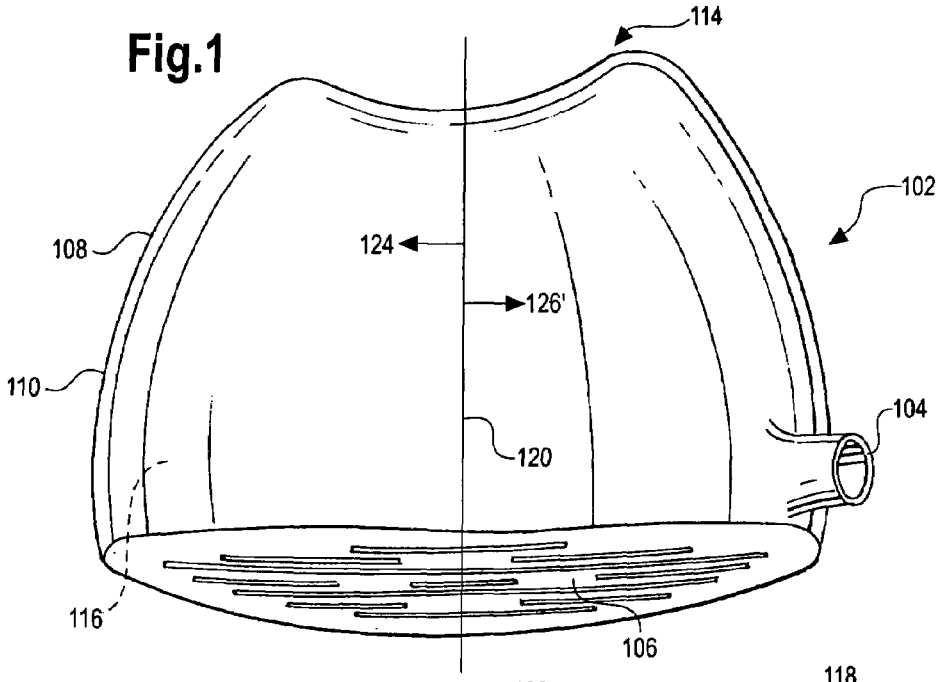
FIG. 1 is a top plan view of one embodiment of a club head of the present invention.

While this invention is susceptible of embodiment in many different forms, there is shown in the drawings and will be described in detail, several specific embodiments with the understanding that the present disclosure is to be considered as an exemplification of the principles of the invention and is not intended to limit the invention to the embodiments illustrated.

In one aspect, the present invention is directed to a golf club having a club head which creates a relatively high moment of inertia around the center of gravity of the club head, and thus results in improved directional stability and flight distance of a hit ball. The moment of inertia of the club head significantly determines the extent to which an individual will be able to obtain this good distance and accuracy even if the ball is not struck perfectly. Since the golf club of the present invention has a higher moment of inertia, the club head is less susceptible to rotate when a ball is not struck by the center of the club face.

Figure 2:
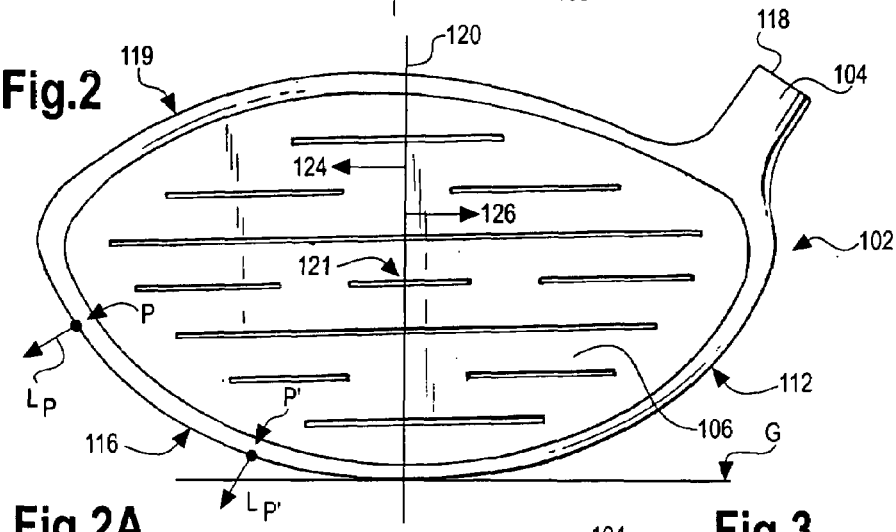
FIG. 2 is a front view of the embodiment of FIG. 1.
Figure 3:
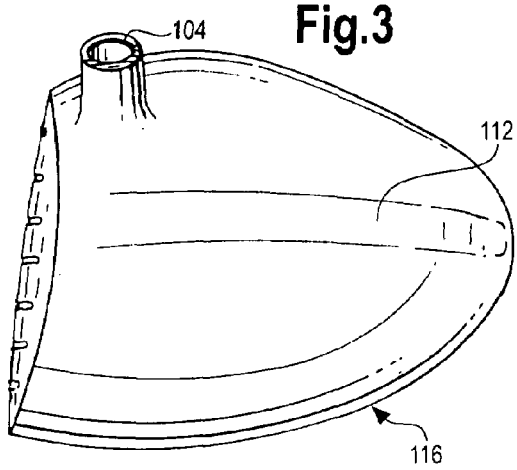
FIG. 3 is a right side elevation view of the embodiment of FIG. 1.

Referring now to the drawings, a golf club 100 having a club head 102 is shown generally in FIGS. 1-3. Club head 102 generally comprises a hosel 104, a club face 106, a top profile shape 108, a toe 110, a heel 112, a rear profile 114, a sole 116, and a crown or top region 119.

Club head 102 is preferably a metallic club head which may be hollow, partially hollow, or solid. A hollow club head is known to have a greater moment of inertia than a non-hollow club head. Thus, in a preferred embodiment, the club is hollow. The club head is preferably formed from a metal such as aluminum, stainless steel, or titanium, including various alloys of such metals, or alternatively may be formed from any other suitable material. The club head can be formed by casting the body in a mold such as by pouring liquid into a form, or by forging the club head in different sections or portions and assembling the club head together by a suitable method, such as by welding the sections together, for example. Some portions may be cast (for example, the body of the club head except for the club face and/or the sole) and some forged (for example, the club face and/or the sole) or formed by any other suitable method. As a non-limiting example, the club head may have a non-metal coating on the head exterior, or a non-metal filler material in the hollow cavity of the club head.

Figure 2A:
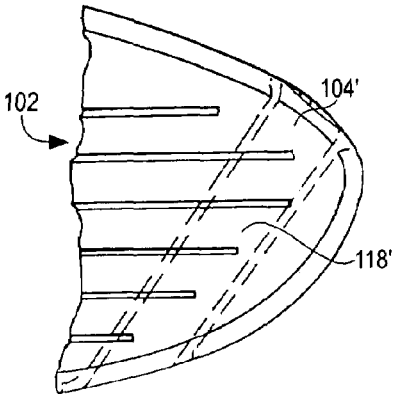
FIG. 2A is a side elevation view of a modified embodiment of FIG. 1 showing an inwardly extending hosel.

Golf club 100 generally has a shaft (not shown) fixedly connected to club head 102 via hosel 104. Two different embodiments of the hosel are shown in FIGS. 2-2A. In one embodiment, as shown in FIG. 2, hosel 104 is an integrally formed component of the club head, and extends externally from the club head and has a generally cylindrical bore 118. In another embodiment, a hosel 104' may extend inward into the body of the club head as shown in FIG. 2A and may be integrally formed or otherwise fabricated as desired. Inward extending bore portion 118' is also preferably generally cylindrical to receive a similarly shaped shaft.

Club face 106 extends between toe 110 and heel 112 of the club head as shown in FIG. 2. Club face 106 is preferably relatively thin. It is contemplated that club face 106 may have a desired spring effect within national and/or international golf rules. Additionally, the club face is preferably slightly curved. In a preferred embodiment, the hitting surface of club face 106 has substantially the same curvature along a transverse direction as a longitudinal direction which curvature may be generally spherical.

Figure 4:
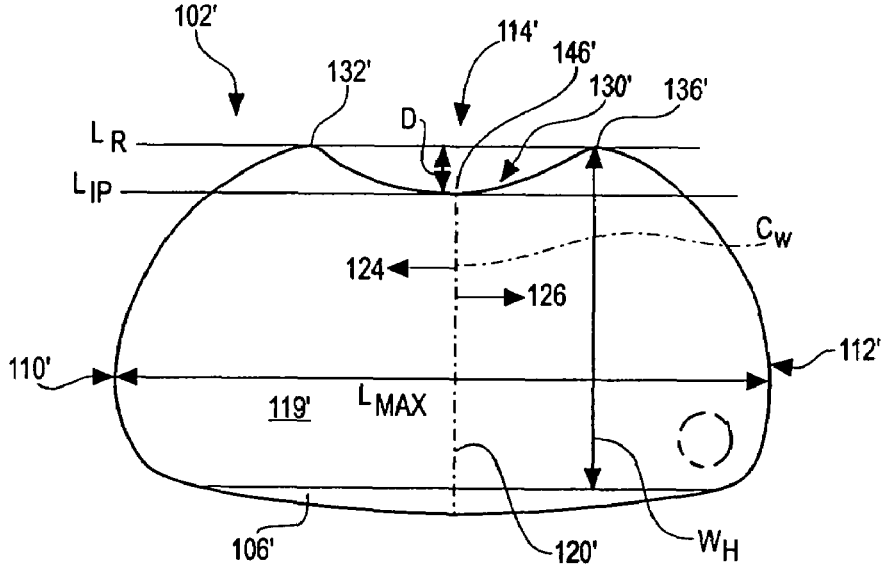
FIG. 4 is a top plan view of an alternate embodiment of the present invention showing a club head having a truncated portion.

Referring to FIGS. 1 and 2, a vertical face centerline plane 120 of club face 106 is conveniently used as a reference in defining the area or region of top profile 108, toe 110, heel 112, rear profile portion 114 of top profile 108, and sole 116 as well as other defined regions of the club head. Vertical face centerline plane 120 extends through the club head from club face 106 to rear profile 114 as a vertical plane that extends along the target line and through the center point 121 (the intended striking point of the club face and the center of the golf ball) of club face 106 when the club head is in a normal address position as shown in FIG. 2. The normal address position describes the position where the club is positioned in the intended lie of the club (the intended angle between the ground and the shaft centerline) and square to the target line, which for most clubs will result in the sole of the club touching the ground G (assumed to be a horizontal surface) from front to back with the sole touching the ground vertically below face center 121. Vertical face centerline plane 120' (similarly oriented as plane 120 is to club head 102) defines a transverse top profile centerline width ("$C_W$") of club head 102' as shown in FIG. 4 with respect to club head 102'.

Figure 9:
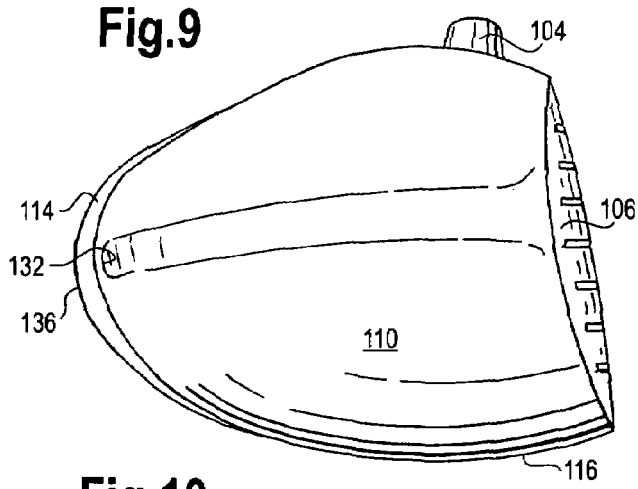
FIG. 9 is a right side elevation view of the embodiment of FIG. 1.
Figure 10:
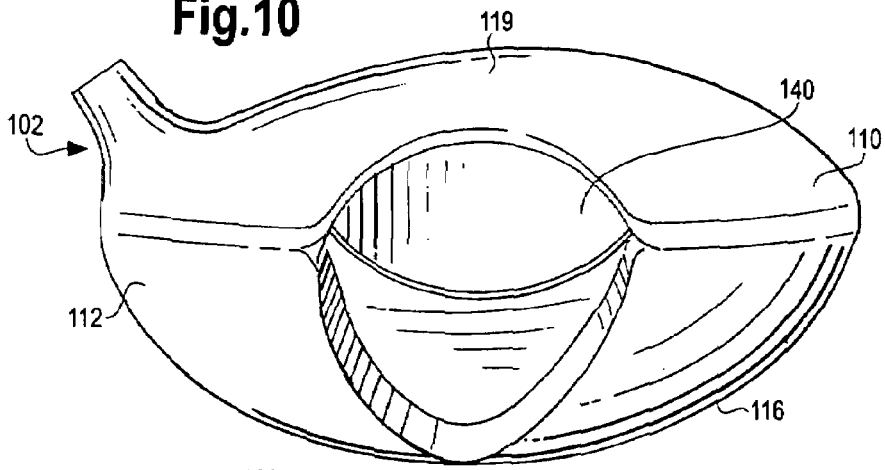
FIG. 10 is a rear elevation view of the embodiment of FIG. 1 showing a truncated portion and a sole recess.

Heel 112 refers to the sidewall region of the club extending vertically between sole 116 to top region 119 as shown in FIG. 3. Toe 110 refers to the sidewall region of club head 102 that includes the side portion opposite from the heel and the portion extending vertically from sole 116 to crown or top region 119 of the club head as shown in FIG. 9. Rear profile 114 is defined horizontally between the toe 110 and heel 112 and vertically between top region 119 and sole 116 as shown in FIG. 10. Top region 119 and sole 116 are defined horizontally between the toe 110 and heel 112 and vertically on a plane above sole 116 and below top region 119, respectively. Crown or top region 119 preferably has a substantially smooth curved shape.

Referring to FIGS. 1 and 2, to determine the extent of toe side 124 and the extent of heel side 126 of club head 102, reference is made to vertical centerline plane 120, which extends through the club head from club face 106 to the rear of the club head (1) through club face centerline plane 120 and (2) along the intended target line when the club is in the normal address position. Thus, vertical plane 120 is a reference plane which divides club head 102 into toe side 124 and heel side 126. The portion of club head 102 divided by the reference plane and including toe 110 is toe side 124 of the club head and the portion of the club head divided by vertical plane 120 and including heel 112 is heel side 126. Thus, the reference plane defines the toe side 124 and heel side 126 of the club head 102. The toe side and heel side can be similarly determined for any club head.

Figure 5:
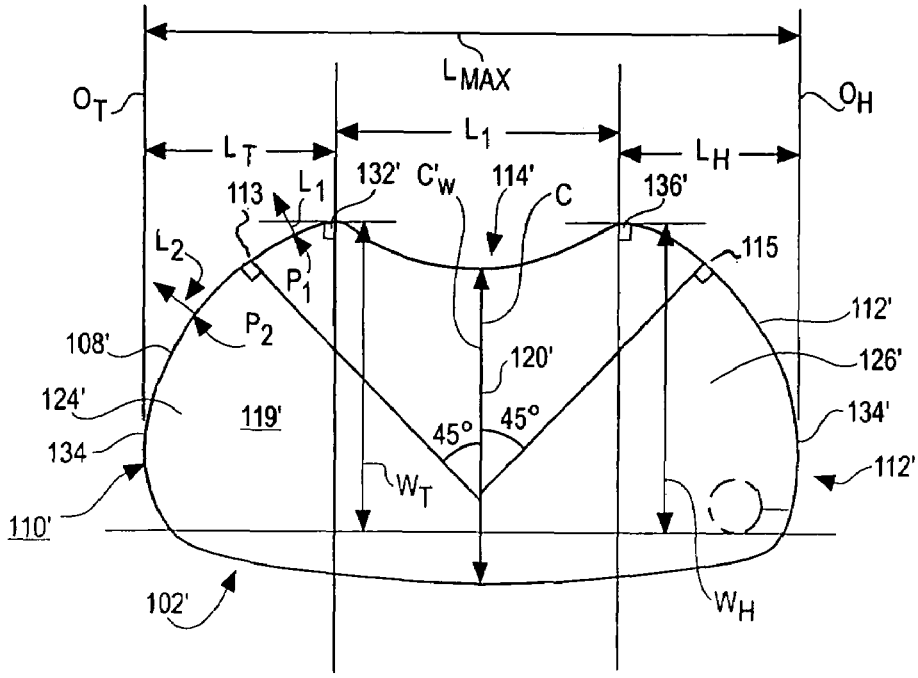
FIG. 5 is another top plan view of the embodiment of FIG. 4.
Figure 6:
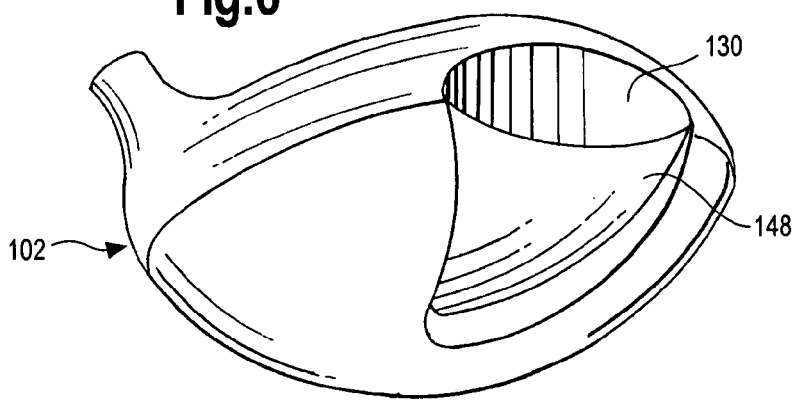
FIG. 6 is a bottom perspective view of the embodiment of FIG. 1 showing a club head having a truncated portion and a sole recess.

For a particular club head, such as club head 102' of FIG. 4, for example, the extent of toe 110', heel 112', rear profile 114', top region 119' and sole 116' is conveniently determined as follows. As shown in FIG. 5, if a point on the surface of toe side 124' and a line extending normal thereto faces more to the back than to the toe side (left) of the club head, it is part of rear profile 114' (for example, point $P_1$ and line $L_1$). Conversely, if a point on toe side 124' faces more to the left side (toe side) of the club head than to the back, it is part of toe 110' (point $P_2$ and line $L_2$). Additionally, if a point on the heel side 126' faces more to the back than to the heel side (right) of the club head, it is part of rear profile 114'. Conversely, if a point on heel side 126' faces more to the heel side (right) of the club head than to the back, it is part of heel 112'. Similarly, relative to the sole extent versus the toe extent, as shown in FIG. 2, a point P on the surface of club head 102 having a line $L_P$ normal thereto that has a greater horizontal extent than a downward vertical extent and thus is considered part of toe 110, whereas a point P' having a line $L_{P'}$ normal thereto that has a greater downward vertical extent than a horizontal extent and thus is considered a part of sole 116. The extent of toe 110 versus crown or top region 119 can be similarly determined, where a line normal to a point on the surface extends upwardly vertically more than horizontally will be considered part of crown or top region 119 rather than toe 110.

Thus, as is also shown in FIG. 5 with respect to club head 102', point 113 defines where toe 110' ends and rear profile 114' begins and is the point on the top profile shape 108' of club head 102' where a line normal (perpendicular) to that point is at a 45° angle to the top profile centerline width. On the heel side, the point where heel 112' ends and the rear profile portion 114' of top profile shape 108' begins is point 115 on the club head top profile shape 108' where a line normal (perpendicular) to that point on the heel side is at a 45° angle to the top profile centerline ("C").

With the aforementioned regions of the club head defined, the present invention includes a number of embodiments which permit an increased moment of inertia in both a horizontal and vertical plane of the club head and particularly in a horizontal plane. The moment of inertia of the club head significantly determines the extent to which an individual will be able to obtain improved distance and accuracy when the golf ball is struck in an off-center hit. In particular, a higher moment of inertia means that the club head will be less susceptible to rotation when a ball is struck with an off-center hit.

A club head which is hollow rather than solid will have a substantially greater moment of inertia. In the former, the mass of the club head is generally equally distributed on the perimeter of the club head by controlling the thickness of the wall of the club head. However, it is understood within the present invention that the mass need not be equally distributed about the club head. Further, it is contemplated that the mass may be added to the club head by any suitable means during fabrication of the club head, and not merely by thickening the walls. For example, the removed weight may be added as plugs on the sole of the club head.

In one aspect of the invention, the moment of inertia of the club head is increased by appropriately varying the maximum length and maximum width of the club head. As shown in FIG. 4, the club head 102' has a top profile maximum length ("$L_{MAX}$") and a transverse top profile centerline width ("$C_W$"), wherein the ratio of $L_{MAX}/C_W$ is in the range of from about 1.5 to about 2.2, preferably about 1.55 to about 1.8, and more preferably from about 1.6 to about 1.7. It is contemplated that when the club head has a ratio of length to width in these ranges, the moment of inertia is increased in both a horizontal and vertical plane. Further, the club head has a preferred volume of at least 225 cubic centimeters. In one preferred embodiment, the volume of the club head is at least about 275 cubic centimeters. In yet another embodiment, the volume of the club head is at least about 325 cubic centimeters.

Figure 7:
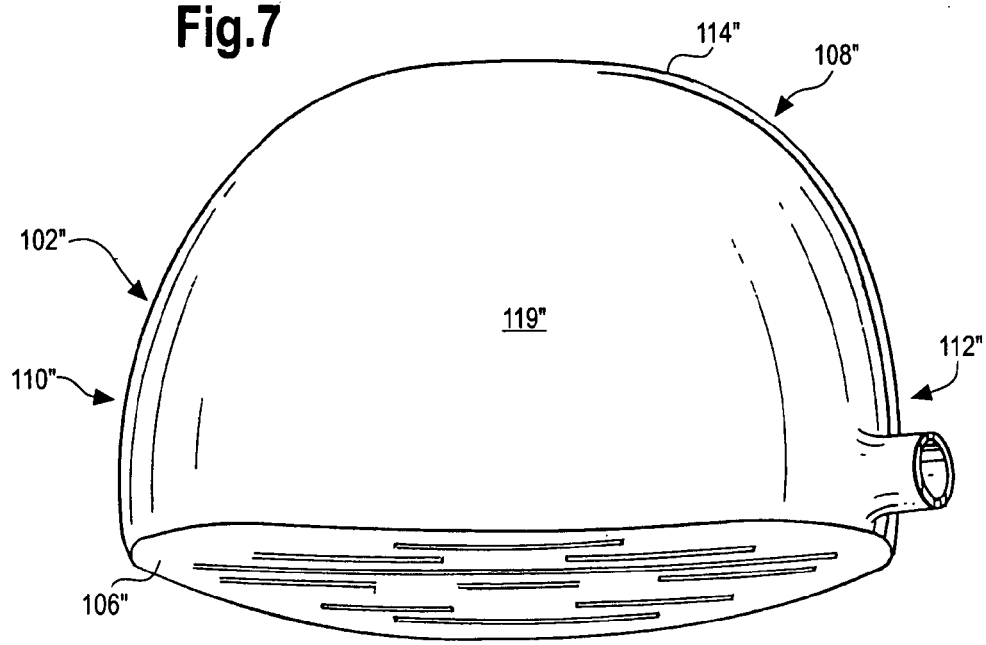
FIG. 7 is a top plan view of another embodiment of the present invention showing a club head having a substantially smooth rear profile curvature.
Figure 8:
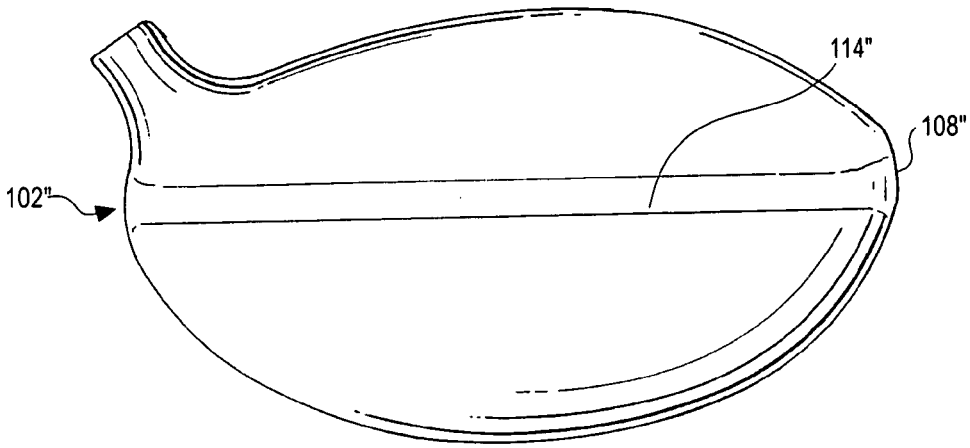
FIG. 8 is a rear elevation view of the embodiment of FIG. 7.

It is contemplated that a golf club head having the aforementioned ratio and volume value configuration may have a substantially smooth curvature about the club head, including a smoothly curved top profile 108" and rear profile portion 114" of top profile 108", as shown in FIGS. 7-8. However, a club head in accordance with the invention may have any other configuration, including any of the embodiments having a truncated rear profile as discussed below, which will yield a club head having a ratio of the top profile maximum length to the transverse top profile centerline width in the range of from about 1.5 to about 2.2 and a volume of at least 225 cubic centimeters.

It is similarly contemplated that the curvature of the club head from the club face on the toe side to the toe side most rearward point and the curvature of the club head from the heel side most rearward point need not be equivalent. For example, where the heel includes a most rearward point which is of a greater distance from the club face than a toe side most rearward point as in club head 102 of FIG. 1, as will be discussed below, the degree of curvature will be less substantial on the toe side.

In a preferred embodiment of the present invention, an example of which is shown in FIGS. 1-3, a portion of rear profile 114 of club head 102 is truncated. The mass removed from the rear portion is preferably redistributed on another part of the club head to increase the moment of inertia of the club head. Further, by truncating a rear portion of the club, the center of gravity is moved closer to the center of the club face along the intended line where a ball is hit as compared to the conventional club head.

For example, in FIGS. 4 and 5, there is shown an embodiment of a club head having a truncated portion 130', wherein a rear portion of the club head has been truncated and the mass redistributed on the toe and heel. The club head has a top profile maximum width ("$W_T$") on the toe side and a top profile maximum width ("$W_H$") on the heel side. Both the top profile maximum width of the toe side and the top profile maximum width of the heel side are larger than the transverse top profile centerline width ("$C_W$") so as to give the appearances of two "humps" or protuberances on the rear portion of the club head as shown in FIGS. 4-5.

In one embodiment shown in FIGS. 4-5, the top profile maximum width of the heel side ("$W_H$") may be substantially equal to the top profile maximum width of the toe side ("$W_T$"). In another embodiment, the top profile maximum width of the heel side has a greater width than the top profile maximum width of the toe side as shown in FIG. 1.

By having a greater top profile width on the heel side, it is understood that the center of gravity can be moved horizontally in a direction from the toe side to the heel side. The distance between the shaft and the center of gravity of the club head is shortened and thus the present invention may also reduce toe down phenomenon and covering of the club head.

In preferred embodiments of the present invention, such as in FIGS. 1 and 4-5, the ratio of the distance ("$L_1$") between (1) a line parallel to the transverse top profile centerline ("C") and extending through the top profile maximum width on the toe side and (2) a second line parallel to the transverse top profile centerline ("C") and extending through the top profile width on the heel side and (3) the top profile maximum length ("$L_{MAX}$") is in the range of between about 0.35 and about 0.70, and is preferably in the range of between about 0.40 and about 0.60. By keeping the ratio values within these ranges, the center of gravity of the club head is maintained along or closely adjacent to a line in which the ball is typically intended to be struck by the club face.

To further maintain the center of gravity on a line along which the ball is typically intended to be struck by the club face, the top profile length ("$L_T$") between (1) a line ("$W_T$") parallel to the transverse top profile centerline plane 120' and extending through the toe side most rearward point 132' and (2) a second line ("$O_T$") which extends parallel to the transverse top profile centerline width ("$C_W$") and intersects an outermost point 134' of toe side 124' is substantially equal to a length ("$L_H$") between (3) a line ("$W_T$") parallel to the transverse top profile centerline and extending through the heel side most rearward point 136' and (4) a line ("$O_H$") which extends parallel to the transverse top profile centerline width and intersects outermost point 134' of heel side 126'. It is understood that the outermost point of the heel side is the outermost point of the heel side excluding hosel 104. Therefore, if a portion of the hosel defines the outermost portion of the heel side, it should be disregarded for defining the outermost point of the heel side.

Figure 11:
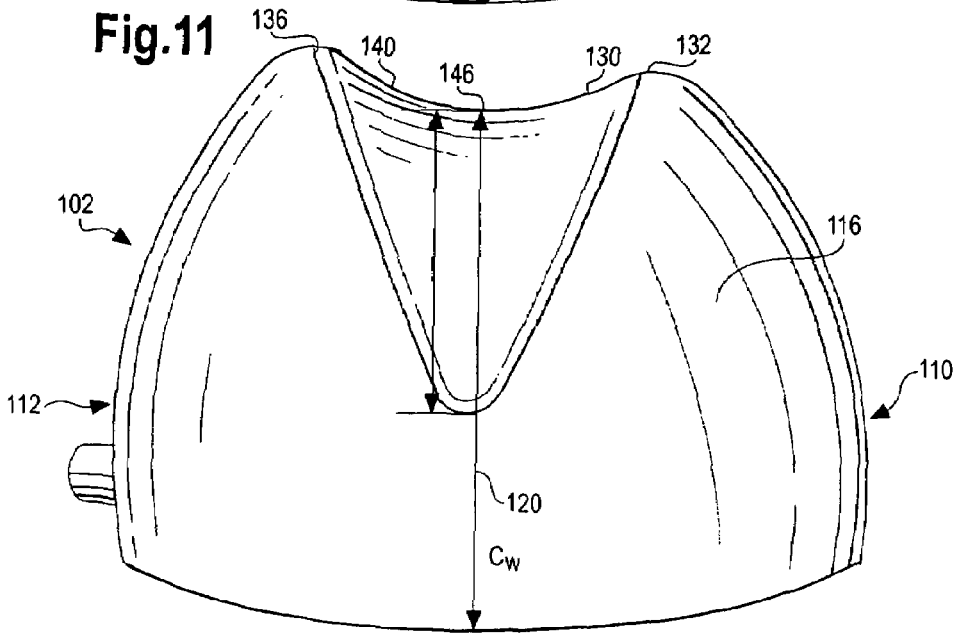
FIG. 11 is a bottom elevation view of the embodiment of FIG. 1.

Truncated portions 130, 130' are disposed between the toe side most rearward point 132, 132' and heel side most rearward point 136, 136' as shown in FIGS. 4-5, 9-11 and 12. The truncated portion may comprise concave rear region 140 which forms a rear portion of the club head as shown in FIG. 10. Further, concave rear region 140 may define a concave rear wall as is also shown in FIGS. 10 and 11.

The truncated portion 130, 130' has a top profile innermost point 146, 146' as shown in FIGS. 4 and 11. In a preferred embodiment, the distance ("D") between (1) a line ("$L_R$") which is parallel to the top profile maximum length ("$L_{MAX}$") and intersects the most rearward points (132', 136') of the toe side and heel side and (2) a line ("$L_{IP}$") which is perpendicular to the transverse top profile centerline and intersects top profile innermost point 146' of truncated portion 130' is 0.20 or less of the top profile maximum width of the heel side ("$W_H$").

The truncated portion removes mass from the rear profile of the club head. However, in another aspect of the invention, to obtain a relative high moment of inertia values for the club head of the present invention, it is preferable to further include with the club head body 102 a recess 148 in sole 116 which extends from the truncated portion 130 as shown in FIGS. 10-11.

Figure 13:
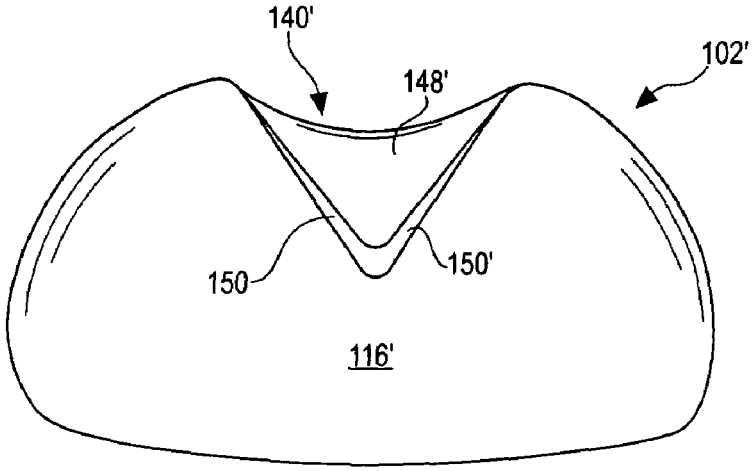
FIG. 13 is a bottom plan view of the embodiment of FIG. 4.
Figure 14A:
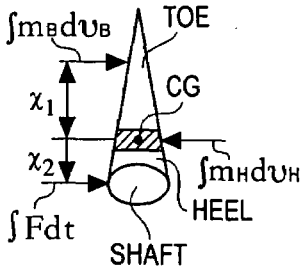
FIGS. 14(*a*)-(*e*) are schematic illustrations showing advantages of club heads in accordance with the present invention.
Figure 14B:
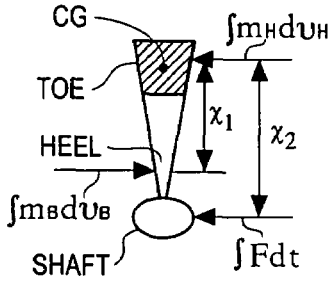
Figure 14C:
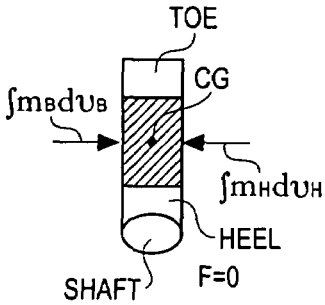
Figure 14D:
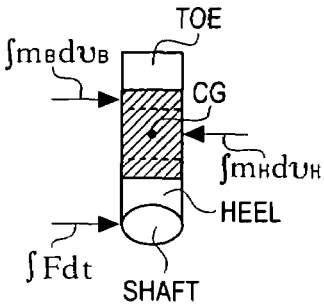
Figure 14E:
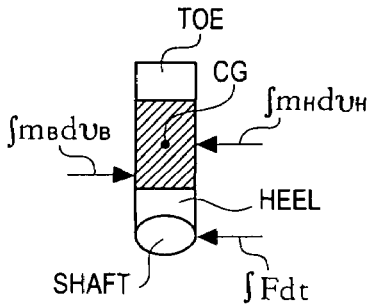

A sole recess 148' is shown in FIG. 13 as extending from concave rear region 140' through a portion of a center of sole 116'. In a preferred embodiment, sole recess 148' is preferably defined by two generally vertical walls 150, 150' having a maximum height in the range of about 0.15 to about 0.30 inches. The sole recess is preferably of substantially the same contour as the adjacent regions of the sole. Additionally, sole recess 148' is preferably of a substantially triangular shape as in FIG. 13, and has an innermost extent 147 as shown in FIG. 11, but may be of a rectangular shape, polygonal shape, or any other desired shape so long as the recess symmetrically removes mass from a central portion of the sole with respect to vertical face centerline plane 120'.

Walls 150, 150' of sole recess 148' preferably decrease in height from an inner portion of the sole recess towards a rear portion of the sole recess as shown in FIG. 13. For example, the walls may taper in height in a direction toward the rear portion of the sole recess. Alternatively, the walls may decrease in height in a stair-like fashion, or may sharply decrease in height at a rear portion of the sole recess. Quantitatively, the sole recess has a volume which is in the range of from about 2% to about 8% of the club head. Further, as shown in FIG. 11, sole recess 148' preferably has a horizontal maximum width ("$SR_w$") that is at least 20% of the transverse top profile centerline width ("$C_W$").

It is further contemplated that in addition to increasing a moment of inertia of the club and moving the center of gravity toward the club face center, sole recess 148 or 148' may also reduce drag of the club as the user moves through his or her swing. Therefore, the sole recess may also reduce damage and extend the lifetime of the club head, and may increase club speed resulting in a shot having a greater distance.

In accordance with the present invention, a wide sweet spot is obtained because of the profile shape of the previously described club heads. While not wishing to be bound by theory, the large, wide sweet spot is believed to result from the following considerations. The sweet spot or zone is a hitting zone in which kinetic momentum of the head can effectively be transferred to a golf ball, and an impact force applied to the golf club grip at the time of golf ball impact is relatively small. As shown in FIG. 14(*a*), when the mass (which can result from the toe side club head thickness or volume) of the toe side is relatively small and the mass of the heel side is relatively great, the center of gravity CG of the head is located toward the heel. When the toe side of the head hits the golf ball as shown schematically in FIG. 14(*a*), the kinetic momentum that the head losses is $\int m_H dv_H$ wherein a mass of the head is $m_H$, a velocity decrease obtained by the head is $dv_H$. If the mass of a golf ball is $m_B$ and a velocity increase of the golf ball is $dv_B$, the increased kinetic momentum obtained by the golf ball is $\int m_B dv_B$. An impulse exerted to the shaft by the head in order to prevent the head from rotating by the $m_B dv_B$ and $m_H dv_H$ is $\int F dt$, wherein a force is F, and time increase is dt.

In the case of FIG. 14(*a*), a force balance is:

$$|\int m_B dv_B|+|\int F dt|=|\int m_H dv_H|.$$

A moment balance is:

$$|\int m_B dv_B|/|\int F dt|=x_2/x_1.$$

If $x_2>x_1$ $$|\int F dt|>|\int m_B dv_B|$$

Therefore, $$|\int m_B dv_B|<|\int m_H dv_H|$$

and thus, only a portion of the kinetic momentum of the head is transmitted to the golf ball, and the golf ball does not fly optimally. Further, since $|\int F dt|$ is not equal to 0, an unwanted reaction force of $|\int F dt|$ is transmitted to the player's hands through the grip.

When the mass (which can result from the toe side club head thickness or volume) of the toe side is relatively great and the mass of the heel side is relatively small as shown in FIG. 14(*b*), the center of gravity CG of the club head is located d toward the toe. When the heel side (root side) of the head hits the golf ball, a force balance is:

$$|\int m_B dv_B|=|\int F dt|+|\int m_H dv_H|+|\int F dt|.$$

A moment balance is:

$$|\int m_B dv_B|/|\int F dt|=x_2/x_1,$$

and since $x_1<x_2$, $$|\int F dt|<|\int m_B dv_B|.$$

Therefore, the player's hands need to withstand an impulse greater than the kinetic momentum that the head loses. As a result, only relatively small kinetic momentum $|\int m_B dv_B|$ which is smaller than the small $|\int F dt|$ is transmitted to the golf ball and a good shot does not result.

Further, when the thickness of the head is substantially uniform from the toe side to the heel side, as shown in FIG. 14(*c*), an increased probability is provided of high momentum transfer to the golf ball and significant impact is not transmitted to the player's hands. When the toe end side of the club face hits the golf ball as shown schematically in FIG. 14(*d*), an adverse influence is smaller than the case shown in FIG. 14(*a*), and when the heel side of the club face hits the golf ball as shown in FIG. 14(*e*), an adverse influence is smaller than the case shown in FIG. 14(*b*). That is, the wide sweet spot can be obtained by substantially making uniform the thickness of the head in a direction from the toe to heel on a vertical projection plane, i.e., by making this portion into a shape that approximates an elongated rectangular shape such as when the length to width ratio is in the range of from about 1.5 to about 2.2. Therefore, if the two protruding regions formed on the heel side and the toe side as in the present invention, such as is shown in FIGS. 1-5, for example as in a club head having a relatively high length to width ratio as shown in FIG. 7, the shape of the head on the vertical projection plane becomes closer to the elongated rectangular shape having a length to width ratio of from about 1.5 to about 2.2, and a wide sweet spot or zone can be obtained.

If the present invention is applied to a fairway wood such as a three or four wood or higher, a beneficial effect can be obtained, as is the case with a driver in accordance with the invention.

Further, because of the truncated rear shape or high length to width ratio, the head gravity center CG is located towards or relatively close to the club face as compared with a head center of gravity $CG_0$ of the typical conventional metal wood club in which the contour shape of the head back surface is a relatively gradual arc. The back profile shape of a club head in accordance with the invention, such as the club head 102', is light in weight as compared with the conventional metal wood club in which the head back surface is heavy, and a golf ball can be readily hit with an original loft angle applied to the club head 102'.

Further, the head gravity center $CG_0$ is located on the side of the club face 106' as compared with a head gravity center CG of the conventional metal wood club. Therefore, a moment of inertia at the time of down swinging is smaller than that of the conventional metal wood club, and it is easy to control a head attitude with the player's hands grasping the grip.

Figure 12:
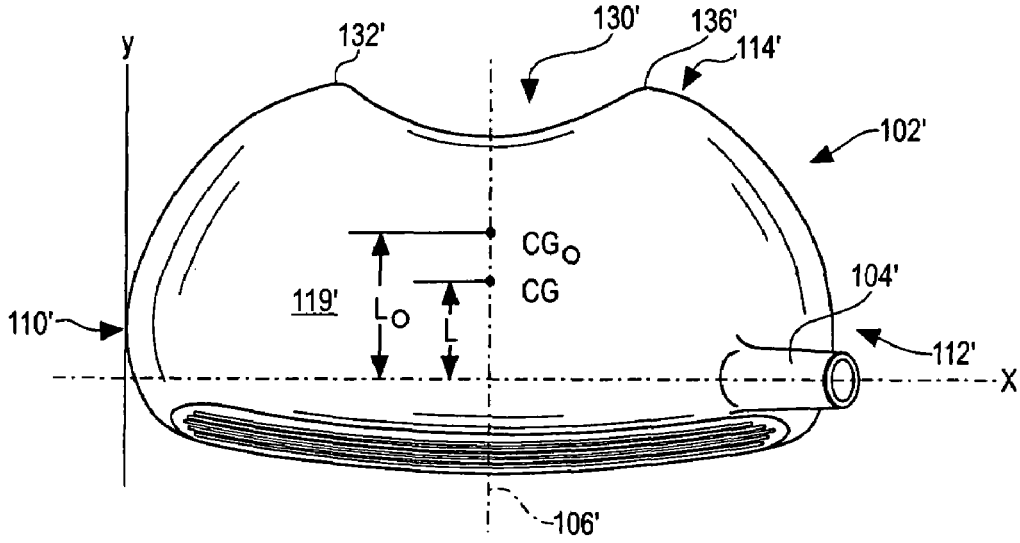
FIG. 12 is a top plan view of the embodiment of FIG. 4.

That is, in the head, as shown in FIG. 12, a case in which an X-axis is set at a position of a shaft center axis, and a Y-axis is set perpendicularly to the X-axis is conceived. If horizontal distances between the X-axis, the head gravity center CG of the head 10 of the present embodiment and a head gravity center $CG_0$ of the conventional head are defined as L and L0, moments of inertia around the head gravity centers CG and $CG_0$ are defined as Ix, moments of inertia IX and IX' around the X-axis are expressed in the following equations:

$$IX=Ix+mL^2$$

$$IX'=Ix+mL0^2$$

are shown, and since L<L0, it becomes $$IX<IX'.$$

Further, there is an adverse possibility that the heel side 112' is pulled rearward until the golf ball is hit by the club face 106', but since the distance between the gravity center CG and the shaft is short, the heel side 112' is hardly pulled rearward at all, and a so-called covering phenomenon in which the toe 110' advances forward is not generated.

Therefore, according to the club head of the present invention, it is possible to allow the club face 106' to hit the golf ball with an original loft angle applied to the club, kinetic momentum of the head 102' can effectively be given to the golf ball, and the golf ball can fly accurately for a long distance.

If the club face 106' hits the ball at its location away from the sweet spot or zone, a reaction force for rotating the golf ball around the head gravity center is applied around the club head 102' at the instant when the club face 106' hits the golf ball due to a reaction force of an impact from the golf ball. According to the club head 102' of the present embodiment, however, since the moment of inertia around the head gravity center CG is great, the club head 102' is less prone to rotate around the head gravity center CG.

That is, a back surface of the club heads 102, 102', 102" of the present invention is substantially elongatedly rectangular shape as compared with a conventional head in which its back surface is substantially a gradual arc shape. Therefore, the moment of inertia around the head gravity center CG is greater than that of the conventional head, the attitude of the head is stabilized at the instant when the golf ball is hit, and the golf ball can fly precisely in the intended direction with substantial carry.

The foregoing description merely explains and illustrates the invention and the invention is not limited thereto except insofar as the appended claims are so limited, as those skilled in the art that have the disclosure before them will be able to make modifications without departing from the scope of the invention.

The invention claimed is:

1. A golf club comprising:

(a) a hollow metallic wood club head having a toe, a heel, a club face, and a top profile shape;

(b) the club head having a top profile maximum length and a transverse top profile centerline width, the ratio of the top profile maximum length to the transverse top profile centerline width being in the range of from about 1.5 to about 2.2; and (c) the club head having a toe side, a heel side and a top profile maximum width on the toe side and a top profile maximum width on the heel side, each of the top profile maximum width of the toe side and the top profile maximum width of the heel side being larger than the transverse top profile centerline width, and the top profile maximum width of the heel side being greater than the top profile maximum width of the toe side.

2. The golf club of claim 1 wherein the ratio of the top profile maximum length to the transverse top profile centerline width is in the range of from about 1.55 to about 1.8.

3. The golf club of claim 1 wherein the ratio of the top profile maximum length to the transverse top profile centerline width is in the range of from about 1.60 to about 1.70.

4. The golf club of claim 1 wherein the ratio of (1) the distance between a line parallel to the transverse top profile centerline and extending through the top profile maximum width on the toe side and a second line parallel to the transverse top profile centerline and extending through the top profile maximum width on the heel side and (2) the top profile maximum length is in range of between about 0.35 and about 0.70.

5. The golf club of claim 1 wherein the ratio of (1) the distance between a line parallel to the transverse top profile centerline and extending through the top profile maximum width on the toe side and a second line parallel to the transverse top profile centerline and extending through the top profile maximum width on the heel side and (2) the top profile maximum length is in range of between about 0.40 and about 0.60.

6. The golf club of claim 1 wherein the top profile length between (1) a line parallel to the transverse top profile centerline and extending through the toe side most rearward point and a line which extends parallel to the transverse top profile centerline and intersects an outermost point of the toe side is substantially equal to (2) a top profile length between a line parallel to the transverse top profile centerline and extending through the heel side most rearward point and a line which extends parallel to the transverse top profile centerline and intersects an outermost point of the heel side.

7. The golf club of claim 1 further comprising a rear profile extending from the toe to the heel of the golf club, the rear profile having a truncated portion extending between a most rearward point of the toe side and a most rearward point of the heel side.

8. The golf club of claim 7 wherein the truncated portion has a top profile innermost point, and wherein the distance between (1) a line which is parallel to the top profile maximum length and intersects the most rearward points of the toe side and heel side and (2) a line which is perpendicular to the transverse top profile centerline and intersects the top profile innermost point of the truncated portion is 20% or less of the top profile maximum width of the heel side.

9. The golf club of claim 7 wherein the truncated portion comprises a concave rear region which forms a rear portion of the club head.

10. The golf club of claim 9 wherein the concave rear region comprises a concave rear wall which forms the rear portion of the club head.

11. The golf club of claim 9 wherein the sole recess is of at least one of a triangular, rectangular, and polygonal shape.

12. The golf club of claim 9 wherein the sole recess has a horizontal maximum width that is at least 20% of the transverse top profile centerline width.

13. The golf club of claim 7 further comprising a sole bounded by the heel, toe, top profile, and club face, the sole having a sole recess extending from the truncated portion through a portion of a center of the sole.

14. The golf club of claim 13 wherein the sole recess is defined by two generally vertical walls having a maximum height in the range of from about 0.15 to about .30 inches.

15. The golf club of claim 13 wherein the sole recess is of substantially the same contour as adjacent regions of the sole of the club head.

16. The golf club of claim 13 wherein the two walls of the sole recess decrease in height from an inner portion of the sole recess towards a rear portion of the sole recess.

17. The golf club of claim 13 wherein the sole recess has a volume which is in the range of from about 2% to about 8% of the volume of the club head.

18. A golf club comprising:

(a) a hollow metal wood club head including a toe, a heel, a club face, and a top profile shape, the club head having a top profile maximum length and a top profile centerline width, a ratio of the top profile maximum length to the top profile centerline width being in the range of from about 1.5 to about 2.2;

(b) the club head having a toe side, a heel side and a top profile maximum width on the toe side and a top profile maximum width on the heel side, each of the top profile maximum width of the toe side and the top profile maximum width of the heel side being larger than the transverse top profile centerline width, and the top profile maximum width of the heel side being greater than the top profile maximum width of the toe side; and (c) the metal club wood club head having a volume of at least 225 cubic centimeters.

19. The golf club of claim 18 wherein the volume of the club head is at least about 275 cubic centimeters.

20. The golf club of claim 18 wherein the volume of the club head is at least about 325 cubic centimeters.

21. The golf club of claim 18 wherein the ratio of the top profile maximum length to the transverse top profile centerline width is in the range of from about 1.55 to about 1.8.

22. The golf club of claim 18 wherein the ratio of the top profile maximum length to the transverse top profile centerline width is in the range of from about 1.6 to about 1.7.

23. The golf club of claim 18 wherein the club head further comprises a top profile maximum width on a toe side and a top profile width on a heel side, each of the top profile maximum width of the toe side and the top profile maximum width of the heel side being greater than the transverse top profile centerline width.

24. The golf club of claim 23 wherein the ratio of (1) the distance between a line parallel to the transverse top profile centerline and extending through the top profile maximum width on the toe side and a second line parallel to the transverse top profile centerline and extending through the top profile maximum width on the heel side and (2) the top profile maximum length is in range of between about 0.35 and about 0.60.

25. The golf club of claim 23 wherein the ratio of (1) the distance between a line parallel to the transverse top profile centerline and extending through the top profile maximum width on the toe side and a second line parallel to the transverse top profile centerline and extending through the top profile maximum width on the heel side and (2) the top profile maximum length is in range of between about 0.40 and about 0.70.

26. The golf club of claim 23 wherein the top profile length between (1) a line parallel to the transverse top profile centerline and extending through the toe side most rearward point and a line which extends parallel to the transverse top profile centerline width and intersects an outermost point of the toe side is substantially equal to (2) a top profile length between a line parallel to the transverse top profile centerline and extending through the heel side most rearward point and a line which extends parallel to the transverse top profile centerline width and intersects an outermost point of the heel side.

27. The golf club of claim 18 further comprising a rear profile extending from the toe to the heel of the golf club, the rear profile including a truncated portion extending in a plane between a most rearward point of a toe side and a most rearward point of a heel side.

28. The golf club of claim 27 wherein the truncated portion comprises a concave rear region which forms a rear portion of the club head.

29. The golf club of claim 27 wherein the concave rear region comprises a concave rear wall which forms the rear portion of the club head.

30. The golf club of claim 27 wherein the truncated portion has a top profile innermost point, and wherein the distance between (1) a line which is parallel to the top profile maximum length and intersects the most rearward points of the toe side and heel side and (2) a line which is perpendicular to the transverse top profile centerline and intersects the top profile innermost point of the truncated portion is 20% or less of the top profile maximum width of the heel side.

31. The golf club of claim 27 further comprising a sale bounded by the heel, toe, top profile, and club face, the sole having a sole recess extending from the truncated portion through a portion of a center of the sole.

32. The golf club of claim 31 wherein the sole recess is defined by two generally vertical walls having a maximum height in the range of from about 0.15 to about 0.30 inches.

33. The golf club of claim 31 wherein the sole recess is of substantially the same contour as adjacent regions of the sole of the club head.

34. The golf club of claim 31 wherein the two walls of the sole recess decrease in height from an inner portion of the sole recess towards a rear portion of the sole recess.

35. The golf club of claim 31 wherein the sole recess has a volume which is in the range of from about 2% to about 8% of the volume of the club head.

36. The golf club of claim 31 wherein the sole recess is of at least one of a triangular, rectangular, and polygonal shape.

37. The golf club of claim 31 wherein the sole recess has a horizontal maximum width that is at least 20% of the transverse top profile centerline width.

38. A golf club comprising:

(a) a hollow metallic wood club head having a toe, a heel, a club face, and a top profile shape;

(b) the club head having a top profile maximum length and a transverse top profile centerline width, the ratio of the top profile maximum length to the transverse top profile centerline width being in the range of from about 1.5 to about 2.2; and (C) the club head having a toe side, a heel side and a top profile maximum width on the toe side and a top profile maximum width on the heel side, each of the top profile maximum width of the toe side and the top profile maximum width of the heel side being larger than the transverse top profile centerline width, and the top profile maximum width of the heel side and the top profile maximum width of the toe side being substantially equal.

39. A golf club comprising:

(a) a hollow metallic wood club head having a toe, a heel, a club face, and a top profile shape;

(b) the club head having a top profile maximum length and a transverse top profile centerline width, the ratio of the top profile maximum length to the transverse top profile centerline width being in the range of from about 1.5 to about 2.2; and (c) the club head having a toe side, a heel side and a top profile maximum width on the toe side and a top profile maximum width on the heel side, each of the top profile maximum width of the toe side and the top profile maximum width of the heel side being larger than the transverse top profile centerline width;

(d) wherein a radius of curvature of a portion of the top profile shape of the club head including a point which defines where the toe ends and the rear profile begins is larger than a radius of curvature of a portion of the top profile shape of the club head including a point which defines where the heel ends and the rear profile begins.

40. The golf club of claim 39 wherein the top profile maximum width of the heel side being greater than the top profile maximum width of the toe side.

41. The golf club of claim 39 wherein the top profile maximum width of the toe side and the top profile maximum width of the heel side are substantially equal.

* * * * *